US005223654A

United States Patent [19]

Fujita

[11] Patent Number: 5,223,654

[45] Date of Patent: Jun. 29, 1993

[54] ELECTRONIC PERCUSSION DEVICE FOR GENERATING A PERCUSSION WAVEFORM USING SHOCK STRENGTH AND VIBRATION OF A BATTER HEAD

[75] Inventor: Akihiro Fujita, Iwata, Japan

[73] Assignee: Kabushiki Kaisha Kawai Gakki Seisakusho, Shijuoka, Japan

[21] Appl. No.: 774,835

[22] Filed: Oct. 11, 1991

[30] Foreign Application Priority Data

Oct. 12, 1990 [JP] Japan ..... 2-274569

[51] Int. Cl.[5] ..... G10H 7/00; G10H 1/02

[52] U.S. Cl. ..... 84/627; 84/663; 84/DIG. 12

[58] Field of Search ..... 84/DIG. 12, 615, 622, 84/627, 647, 653, 659, 663

[56] References Cited

U.S. PATENT DOCUMENTS 4,932,303 6/1990 Kimpara ..... 84/621

5,009,146 4/1991 Manabe et al. ..... 84/622

*Primary Examiner*—William M. Shoop, Jr.

*Assistant Examiner*—Jeffrey W. Donels

[57] ABSTRACT

Changes in vibratory position of a batter head of a percussion are detected to output a decay vibration waveform by a detector. A tone source controller sequentially generates a plurality of tone source control codes on the basis of the decay vibration waveform data along time lapse. A tone source circuit controls a reading operation of digital waveform data of percussion tones stored in a waveform memory, and modification of readout data on the basis of the tone source control codes, to generate a tone waveform signal.

6 Claims, 3 Drawing Sheets

ELECTRONIC PERCUSSION DEVICE FOR GENERATING A PERCUSSION WAVEFORM USING SHOCK STRENGTH AND VIBRATION OF A BATTER HEAD

BACKGROUND OF THE INVENTION

1. Field of the Invention

The present invention relates to an electronic percussion device for electronically generating percussion tones of, e.g., drums.

2. Description of the Prior Art

An electronic percussion comprising a batter head portion, detection means for detecting that the batter head portion is beaten, and a digital (PCM) tone source controlled with an output from the detection means is known. As the detection means, a piezoelectric element, a capacitor microphone, a moving coil type microphone, or the like is used. In another electronic percussion device strength is detected by a switch having two contacts arranged in a depression direction of a batter head portion, and having different operation depths.

In a conventional electronic percussion device, the strength of a shock applied to the batter head portion can only be detected. Therefore, in the conventional electronic percussion, device parameters are necessary for a control code for controlling an output waveform of a waveform ROM as a PCM tone source, and a parameter associated with the tone volume is provided on the basis of the shock strength, and other parameters such as a tone sustain time, a change in waveform envelope over time, and the like are electronically formed based on a programmed pattern codes. For this reason, the conventional electronic percussion device can only perform a monotonous performance.

SUMMARY OF THE INVENTION

The present invention has been made in consideration of the above-described problem, and has as its object to provide an electronic percussion device which can obtain not only the strength of a shock applied to a batter head portion, but also parameters such as a tone sustain time, a waveform decay amount, and the like on the basis of detection of a vibration on the batter head portion, and can allow a colorful percussion performance.

An electronic percussion device according to the present invention comprises a batter head portion supported by an elastic member, batter head vibration detection means for detecting a change vibration of the batter head portion upon beating of the batter head portion as a voltage signal, and tone source control means for generating a control code for a tone waveform output to be generated by a digital tone source circuit on the basis of an output voltage waveform from the batter head vibration detection means.

The batter head vibration detection means can output a decay vibration waveform corresponding to a vibration of the batter head portion. Based on this decay vibration waveform, tone duration control, amplitude decay control, and the like for a tone waveform output of a digital tone source are performed. Since parameters of a code for making these control operations are based on the physical amounts of the vibration of the batter head portion along time lapses, a player can enjoy colorful percussion performances in accordance with constants of a vibration system of the batter head portion, and beating performances.

DETAILED DESCRIPTION OF THE PREFERRED EMBODIMENT

Figure 1:
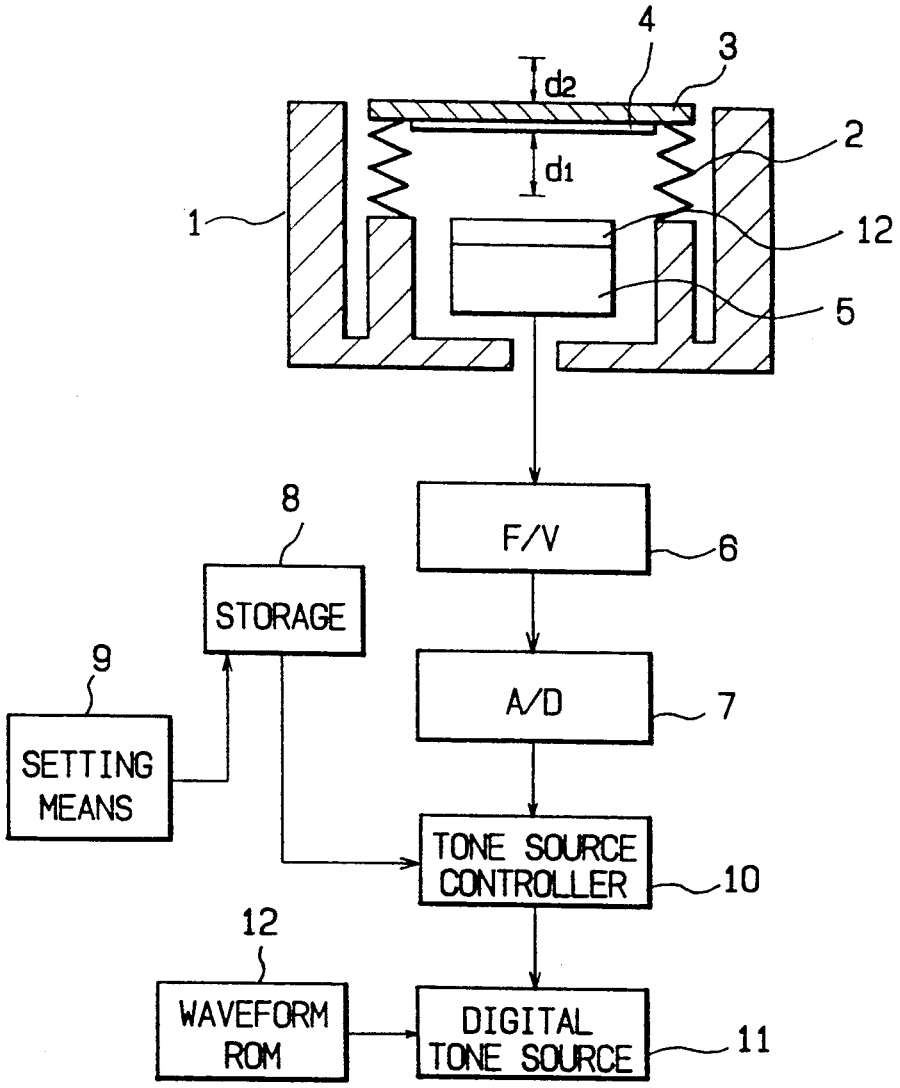
FIG. 1 is a diagram showing a mechanical system and an electrical system of an electronic drum pad according to an embodiment of an electronic percussion of the present invention.

FIG. 1 is a diagram showing a mechanical system and an electrical system of an electronic drum pad according to an embodiment of an electronic percussion device of the present invention. A batter head portion (pad) 3 supported by a spring 2 is arranged in an opening of an upper portion of a pad main body 1. A metal foil 4 is adhered to the rear surface of the batter head portion 3. A batter head distance detection means 5 is arranged in the pad main body 1 to oppose the metal foil 4. In this embodiment, the batter head distance detection means 5 comprises a metal proximity detector.

When a shock is applied to the batter head portion 3, the batter head portion 3 vibrates since it is supported by the spring 2. A change in distance caused by this vibration is detected by the batter head vibration detection means 5 as a change in output frequency.

The output from the batter head vibration detection means 5 is supplied to a frequency/voltage (F/V) converter 6, and is converted into a voltage waveform signal representing the vibration waveform. The voltage waveform signal is converted into a digital signal by an A/D converter 7, and the digital signal is supplied to a tone source controller 10. The tone source controller 10 converts the output signal from the A/D converter 7 into tone source control codes on the basis of tone source control data stored in advance in a storage 8 upon operation of a tone source control data setting means 9, and outputs the codes to a tone source 11. The tone source 11 reads out a PCM signal of, e.g., a drum tone from a waveform ROM 12, and controls the amplitude, the change in envelope, the sustain time, and the like of the output waveform from the waveform ROM 12 on the basis of the input tone source control codes. Then, the tone source 11 outputs the controlled output waveform as a tone signal to an external tone generation section comprising an amplifier, a loudspeaker, and the like.

Figure 2:
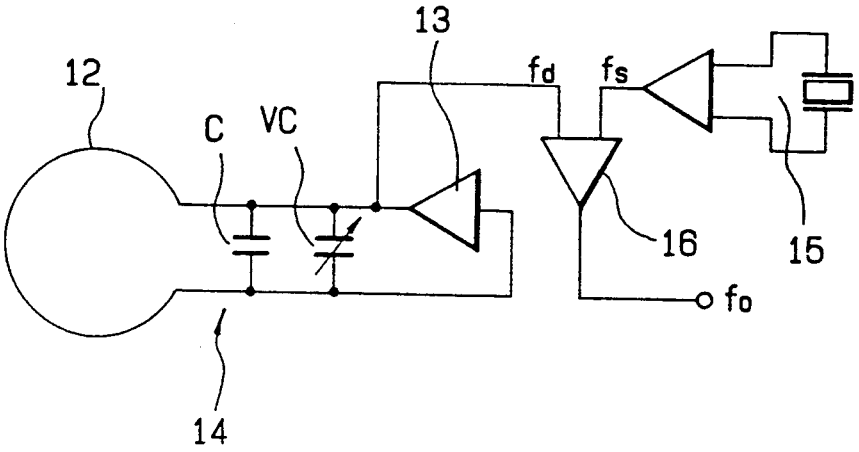
FIG. 2 is a circuit diagram showing an arrangement of a batter head distance detection means shown in FIG. 1.

FIG. 2 shows a circuit arrangement of the metal proximity detector as an example of the batter head vibration detection means 5. The metal proximity detector is a self-excited oscillation type, and comprises a self-excited oscillator 14 constituted by a search coil 12 opposing the metal foil 4 on the rear surface of the batter head portion 3, a capacitor C and a variable capacitor VC, which are connected in parallel with the search coil 12, and a positive feedback amplifier 13. An oscillation frequency fd of the self-excited oscillator 14 is compared with a reference frequency fs of a quartz oscillator 15 by a frequency comparator 16, and a frequency fo corresponding to the difference between the two frequencies is output as a beat output.

When the batter head portion 3 is vibrated, the distance between the search coil 12 and the metal foil 4 changes, and the self-excited oscillation frequency is changed according to the change in distance due to a load effect for the search coil 12. Therefore, the frequency comparator 16 can obtain a beat signal whose frequency changes according to the distance.

Figure 3:
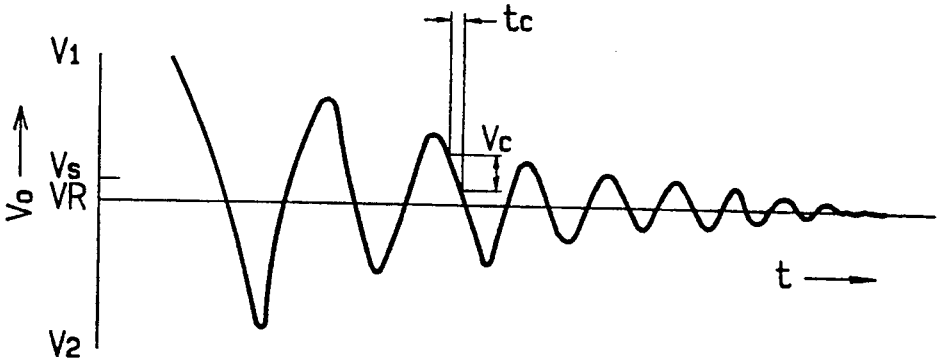
FIG. 3 is an output waveform chart of a frequency/-voltage converter shown in FIG. 1.

FIG. 3 shows an output waveform of the F/V converter 6. When the batter head portion 3 is still, the batter head distance detection means 5 outputs a constant reference frequency fr. In this case, the F/V converter 6 outputs a reference voltage VR.

When a shock is applied to the batter head portion 3, the batter head portion 3 is moved by a distance d1, and is then returned to a distance d2 by the elastic force of the spring 2. Thereafter, the batter head portion 3 is decay-vibrated. Therefore, the output from the F/V converter 6 has a decay vibration waveform having voltages V1 and V2 corresponding to the distances d1 and d2 as an initial state, as shown in FIG. 3.

Parameters corresponding to a threshold voltage Vs (FIG. 3) and the magnitude of a voltage change Vc within a predetermined period of time tc, and control codes corresponding to positions of the batter head are designated in advance by the tone source control data setting means 9, and is stored in the storage 8.

Figure 4:
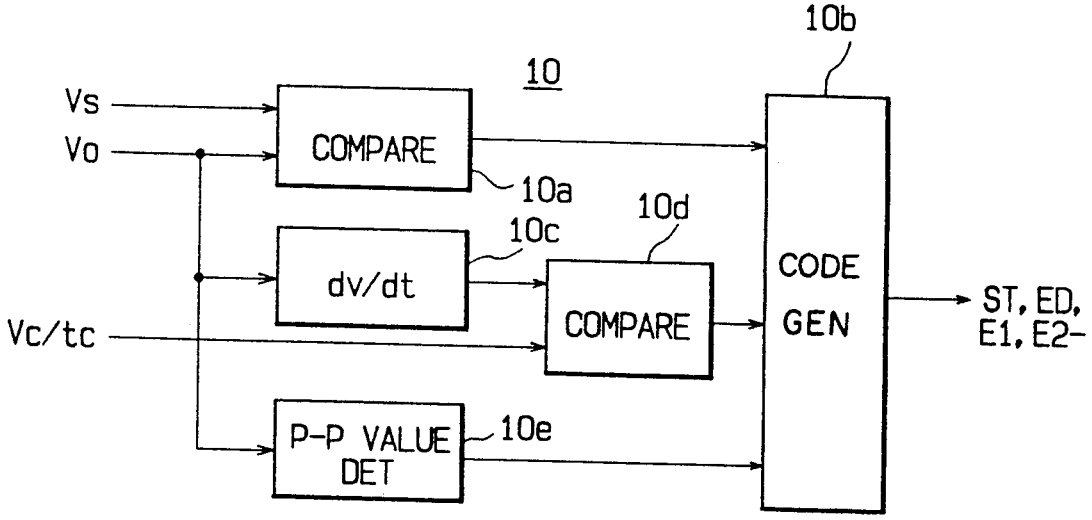
FIG. 4 is a block diagram showing an arrangement of a tone source controller shown in FIG. 1.

FIG. 4 shows an arrangement of the tone source controller 10. When a shock is applied to the batter head portion 3, if an output voltage Vo from the F/V converter 6 is higher than the threshold voltage Vs, a compare means 10*a* detects this, and a code generator 10*b* generates a tone start instruction code ST to the tone source 11 on the basis of the output from the compare means 10*a*. When the vibration of the batter head portion 3 is attenuated, the output from a change rate detection means 10*c* for detecting a change in output voltage Vo from the F/V converter is decreased. When the rate of change in Vo becomes smaller than the voltage change amount Vc within the predetermined period of time tc, a compare means 10*d* detects this, and the code generator 10*b* outputs a tone stop instruction code ED to the tone source 11 on the basis of the detection output from the compare means 10*d*.

During a period between the start and stop of tone generation, the amplitude (P-P value) of the output voltage Vo from the F/V converter 6 is detected by a detection means 10*e*, and the code generator 10*b* sequentially outputs amplitude control codes E1, E2, . . . having the detected values as variables to the tone source 11. Therefore, an envelope corresponding to the decay vibration shown in FIG. 3 is given to the output waveform from the tone source 11.

Instantaneous values of the vibration waveform shown in FIG. 3 may be sequentially input as tone source control codes for controlling the cutoff frequency of a filter in the tone source 11, so that the harmonic configuration of a tone color in a tone is cyclically changed, and the magnitude of the change is gradually decreased to obtain a special tone effect.

The electronic percussion device of the present invention detects the vibration of the batter head portion on the basis of distance detection, as described above, and a tone waveform output of the digital tone source is controlled on the basis of the detected vibration waveform. Thus, a tone waveform physically corresponding to the vibration of the batter head portion can be generated. Therefore, more colorful percussion performance tones can be obtained as compared to a conventional electronic percussion which detects only the strength of a shock applied to a batter head portion to generate a tone waveform.

What is claimed is:

1. An electronic percussion device comprising:

a batter head portion supported by an elastic member;

batter head vibration detection means for outputting a voltage signal corresponding to vibration of said batter head portion upon beating of said batter head portion;

tone source control storage means for storing control codes including a tone start instruction code, a tone stop instruction code, and amplitude control codes;

tone source control data setting means for associated the control codes stored in said tone source control storage means with a decay of he voltage signal output from said batter head vibration detection means;

tone source control means for generating tone source control codes on the basis of the voltage signal output from said batter head vibration detection mans and the control codes associated in said tone source control data setting means;

wherein said tone source control codes are utilized by a digital tone source circuit to read and modify percussion tone data stored in a waveform memory to produce a percussion waveform;

wherein said tone source control means includes detection means for detecting that a rate of change of an amplitude of the voltage signal output from said batter head vibration detection means is less than a predetermined value, and code generation means for generating the tone stop control code when the rate of change output from said batter head vibration detection means is less than the predetermined value and outputting the tone stop control code to the digital tone source circuit.

2. The electronic percussion device of claim 1, wherein said detection means detects that the amplitude of the voltage signal output from said batter head vibration detection means is greater than the predetermined threshold voltage, and said code generation means generates the tone start instruction code when the amplitude detected by said batter head vibration detection means is greater than the predetermined threshold voltage and outputs the tone start instruction code to the digital tone source circuit.

3. The electronic percussion device of claim 1, wherein said detection means detects a peak-to-peak value of the voltage signal output from said batter head vibration detection means, and said code generation means generates the amplitude control codes for controlling an envelope of he voltage signal using the detected peak-to-peak value and outputs the amplitude control codes to the digital tone source circuit.

4. An electronic percussion device, comprising:

batter head means adapted to be struck by a operator;

batter head vibration detecting means for outputting a frequency signal corresponding to vibrating changes in a position of said batter head means;

frequency converting means for converting the frequency signal to an analog voltage signal;

A/D converting means for converting the analog voltage signal to a digital voltage signal;

tone source control storage means for storing control codes including a tone start instruction code, a tone stop instruction code, and amplitude control codes;

tone source control means for generating tone source control codes from the control codes stored in said tone source control storage means and from the digital voltage signal;

digital tone source means for modifying an amplitude, a change in envelope, and a sustain time of a PCM signal stored in a waveform ROM, based on the tone source control codes generated by said tone source control means to produce a percussion waveform;

wherein said tone source control means includes detection means for detecting that a rage of change of an amplitude of the voltage signal output from said batter head vibration detection means is less than a predetermined value, and code generation mans for generating the tone stop control code when the rate of change output from said batter head vibration detection means is less than the predetermined value and outputting the tone stop control code to said digital tone source means.

5. The electronic percussion device of claim 4, wherein said detecting means detects that the amplitude of the voltage signal output from said batter head vibration detection means is greater than a predetermined threshold voltage, and said code generation means generates the tone start instruction code when the amplitude detected by said batter head vibration detection means is greater than the predetermined threshold voltage and outputs the tone start instruction code to said digital tone source means.

6. The electronic percussion device of to claim 4, wherein said detection means detects a peak-to-peak value of the voltage signal output from said batter head vibration detection means, and said code generation means generates the amplitude control codes for controlling an envelope of the voltage signal using the detecting peak-to-peak value and outputs the amplitude control codes to said digital tone source means.

* * * * *